US008607517B2

(12) United States Patent
Jolly

(10) Patent No.: US 8,607,517 B2
(45) **Date of Patent: *Dec. 17, 2013**

(54) TOWER FOUNDATION

(71) Applicant: Tony Jolly, Houston, TX (US)

(72) Inventor: Tony Jolly, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/932,690

(22) Filed: Jul. 1, 2013

(65) Prior Publication Data

US 2013/0291454 A1 Nov. 7, 2013

Related U.S. Application Data

(60) Continuation-in-part of application No. 13/752,897, filed on Jan. 29, 2013, now Pat. No. 8,499,513, which is a continuation-in-part of application No. 13/459,569, filed on Apr. 30, 2012, now Pat. No. 8,438,815, which is a division of application No. 12/317,063, filed on Dec. 18, 2008, now Pat. No. 8,220,213.

(60) Provisional application No. 61/008,742, filed on Dec. 21, 2007.

(51) Int. Cl.
*E02D 27/38* (2006.01)

(52) U.S. Cl.
USPC ..... 52/292; 52/298; 52/651.01

(58) Field of Classification Search
USPC ..... 52/292, 294–298, 745.04, 651.01, 831
See application file for complete search history.

(56) References Cited

U.S. PATENT DOCUMENTS

| | | | |
|---|---|---|---|
| D55,135 | S | 5/1920 | Maxwell |
| 1,366,179 | A | 1/1921 | Heckle |
| 3,803,855 | A | 4/1974 | Malkiel |
| 3,924,413 | A | 12/1975 | Marsh, Jr. |
| 4,217,738 | A | 8/1980 | Smith |
| 4,218,859 | A | 8/1980 | Sams |
| 4,232,846 | A | 11/1980 | Bressani |
| 5,338,499 | A | 8/1994 | Ryynanen |
| 5,586,417 | A | 12/1996 | Henderson et al. |
| 5,826,387 | A | 10/1998 | Henderson et al. |

(Continued)

FOREIGN PATENT DOCUMENTS

| | | |
|---|---|---|
| DE | 3707641 | 12/1987 |
| WO | 0236898 | 5/2002 |

OTHER PUBLICATIONS

USPTO Office Action dated Sep. 28, 2011 for parent U.S. Appl. No. 12/317,063.

(Continued)

*Primary Examiner* — William Gilbert
*Assistant Examiner* — Alp Akbasli
(74) *Attorney, Agent, or Firm* — D'Ambrosio & Menon, PLLC; Usha Menon

(57) ABSTRACT

The foundation structure includes a plurality of structural members. A first end of each structural member is coupled to a central shaft. In appropriate soil conditions, the foundation structure is buried in the soil and the soil itself constrains the mass at the base of the foundation and keeps it from moving. The foundation structure is made of structural components comprises a material, including concrete pre-cast concrete, cast-in place concrete, reinforced concrete, pre-stressed concrete, pre-tensioned concrete and post-tensioned concrete, for resisting the expected forces transferred from the tower.

17 Claims, 2 Drawing Sheets

(56) References Cited

U.S. PATENT DOCUMENTS

| | | | |
|---|---|---|---|
| 6,672,023 | B2 | 1/2004 | Henderson |
| 7,755,210 | B2 | 7/2010 | Kammer et al. |
| 2002/0194794 | A1 | 12/2002 | Hill et al. |
| 2003/0151260 | A1 | 8/2003 | Siegfriedsen |
| 2004/0111991 | A1 | 6/2004 | Swinimer |
| 2004/0154236 | A1 | 8/2004 | Kinzer |
| 2004/0226236 | A1 | 11/2004 | Pidgeon |
| 2006/0140761 | A1 | 6/2006 | LeMieux |
| 2007/0124025 | A1 | 5/2007 | Schram et al. |
| 2008/0217022 | A1 | 9/2008 | Deans |

OTHER PUBLICATIONS

USPTO Notice of Allowance dated Apr. 8, 2013 for related U.S. Appl. No. 13/752,897.

TOWER FOUNDATION

PRIORITY CLAIM

This application is a continuation-in-part of U.S. application Ser. No. 13/752,897 filed Jan. 29, 2013, which is a continuation-in-part of U.S. application Ser. No. 13/459,569 filed Apr. 30, 2012, which is a division of U.S. application Ser. No. 12/317,063, filed Dec. 18, 2008, now issued as U.S. Pat. No. 8,220,213, which claims benefit of Provisional U.S. Patent Application No. 61/008,742 filed on Dec. 21, 2007.

FIELD OF THE INVENTION

A foundation for a tower.

BACKGROUND

Harnessing wind energy is becoming more widespread and acceptable as a viable means of generating electrical power for industrial and consumer uses. Large scale capture and conversion of wind energy requires the placement of wind turbines at a suitable elevation above the ground to capture the wind flow free from the interference and turbulence caused by the terrain surface. To achieve placement at such height, towers are used to support the wind turbines at the proper elevation. The towers are subjected to high winds that create tensile forces on the windward side of the tower and compression forces on the leeward side. These forces can be transferred to the foundation. Due to the small electrical generation capacity of each individual wind turbine, numerous towers are typically required.

SUMMARY

The present disclosure involves decoupling the required mass for the foundation from the structural components needed to resist compression and tension forces. The present disclosure includes a foundation structure made of structural components comprising pre-cast concrete, cast-in place concrete, reinforced concrete, pre-stressed concrete, pre-tensioned concrete and post-tensioned concrete, or other materials for resisting the expected forces transferred from the tower. In appropriate soil conditions, this foundation structure may be covered with non-cementitious materials or fill of any type to provide the required mass to stabilize the foundation and the tower. Avoiding the use of concrete, as fill material, to provide mass decreases the cost and carbon footprint of the tower. The fill may be soil or aggregate local to the tower site, increasing operational efficiency. An embodiment of the present disclosure may include a foundation structure, which is pre-fabricated or easily assembled from a kit.

In one embodiment, the foundation structure for a tower includes a plurality of structural members. Each of the structural members comprises pre-cast concrete, cast-in place concrete, reinforced concrete, pre-stressed concrete, pre-tensioned concrete and post-tensioned concrete, or other materials wherein each of the structural members comprises a base member. The base member of each structural member is coupled to the base member of an adjacent structural member to form a base for the foundation structure. The foundation structure further includes a central shaft. A first end of each of the structural members is coupled to the central shaft. The central shaft has a diameter to match a tower to be mounted on the foundation structure. The foundation structure is placed within a pit and covered with a sufficient volume of a particular fill such that a tower coupled to the central shaft is held in position by the fill.

Each of the structural members comprises a top surface. At least a portion of the top surface comprises a channel for receiving the fill. At least a portion of the channel extends along the length of the structural member. A void is defined between each adjacent structural member. The void is configured to receive the fill.

The base can be coupled to a plate. The plate comprises a material of sufficient strength and thickness to support at least the weight of the threshold volume of fill. The plate comprises a steel and/or concrete plate.

The foundation structure further comprises a fastening member located at the top of the central shaft. The fastening member connects the foundation structure to the base of the tower.

The structural members are coupled to the central shaft by at least one of the group consisting of bolts, studs, welds, grouting, and/or threaded receivers. The structural members further comprise a plurality of steel and/or concrete plates.

The foundation structure further comprises one or more sensors. The one or more sensors further comprises mechanical strain sensors, fatigue sensors, and/or corrosion sensors.

In another embodiment, the tower foundation comprises: the foundation structure discussed earlier, positioned inside an excavated pit; and a volume of the fill such that the weight of the volume of the fill is sufficient to counteract an expected tension load transferred to the foundation structure from the tower. The depth of the excavated pit is sufficient to contain the foundation structure with a top of the foundation structure located within plus or minus 3 feet of the ground surface.

In another embodiment, a method of forming a foundation for a tower, comprises: placing the foundation structure in an excavated pit, and covering the foundation structure with non-cementitious fill material. The foundation structure is pre-fabricated. The method further comprises constructing the foundation structure in the excavated pit.

BRIEF DESCRIPTION OF THE DRAWINGS

So that the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
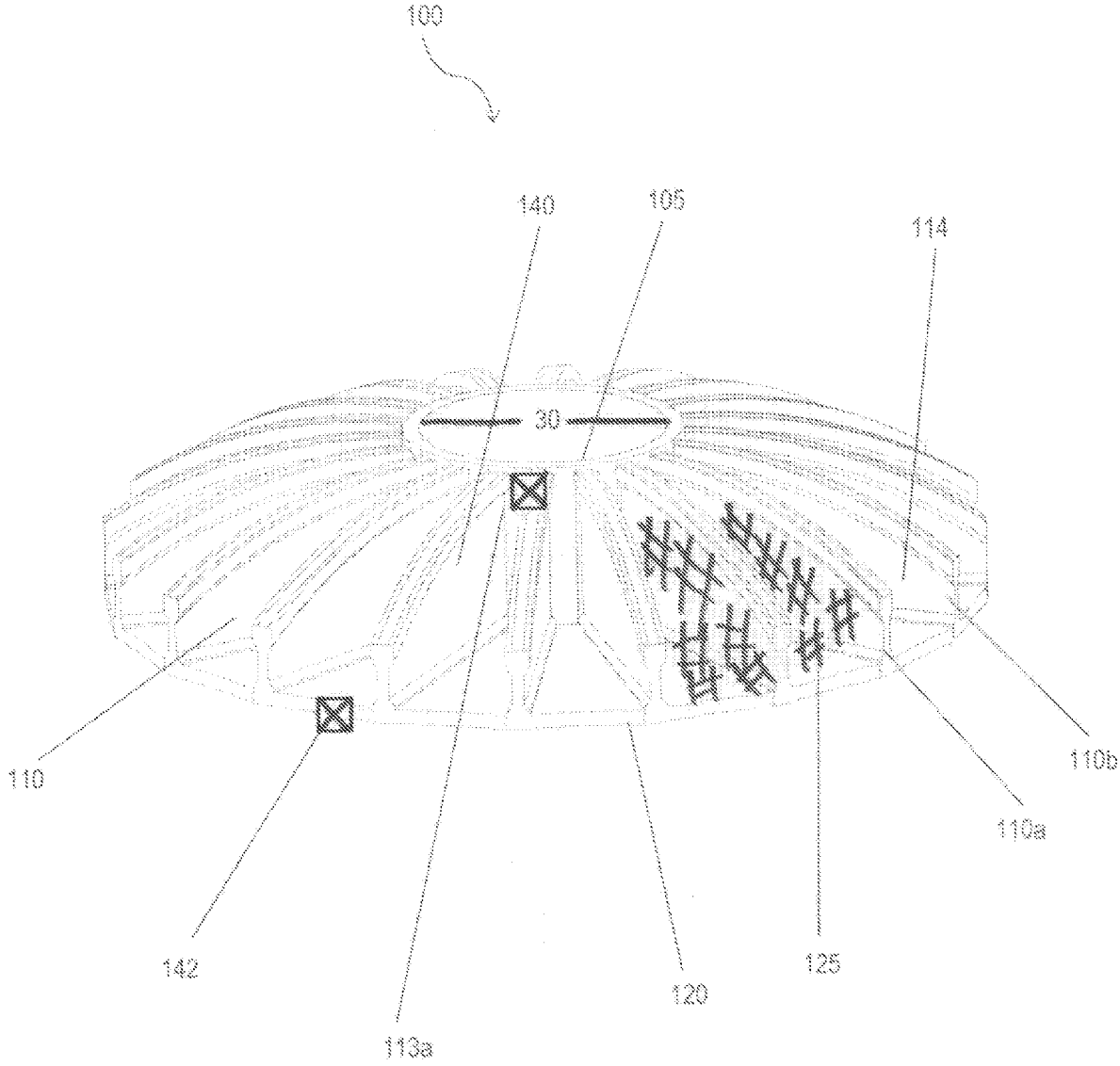
FIG. 1 is a plan view of a foundation structure according to an embodiment of the invention.

The typical method of constructing foundations for the wind turbine towers involves pouring a concrete base to support each of the towers. The concrete is poured into a plurality of forms containing tons of rebar. This requires the foundation be built at the construction site where it is subject to weather conditions, crew availability, and other factors which may lead to delay. Due to the fact construction of the foundations are often on the critical path for the project, any delays can impact project completion and have considerable negative financial consequences.

Costs and logistics for transporting concrete are high, and the wind turbines are often installed in remote areas where locally sourced concrete may not be available. Constructing tower foundations is usually carried out by setting up a cement batch plant at the construction site. This method of tower foundation construction still requires the transport of large amounts of water, dry cement, and rebar to the location, which increases construction costs.

Once constructed, it is very difficult to inspect the interior of the foundation and determine if any fatigue or corrosion damage is occurring. At the end of the project, it is difficult and expensive to remove the concrete foundations. If the foundation is left on the location, this results in ongoing legal exposure and site monitoring requirements. A substantial mass of concrete (reinforced with rebar) is required in typical foundations to stabilize the tower against lifting forces resulting from loads transferred from the tower to the foundation. Concrete has a large carbon footprint, which also may be detrimental to the environment.

The foundation for the tower is a way of grouping mass and/or force at the base of the tower and using structural elements to transfer forces between the mass and the tower. In the embodiments of the present disclosure, the mass is not constrained by a container, such as a storage tank, that is part of the foundation. Instead, in appropriate soil conditions, a foundation structure can be buried in the soil and the soil/fill itself constrains the mass at the base of the foundation and keeps it from moving. As used herein, the term soil includes any fill material, and preferably, non-cementitious fill material that can provide mass ballast for the foundation. The fill may be obtained locally to the construction site or from the construction site itself. In some instances, the fill may be obtained as a byproduct of the construction itself.

The present invention relates to a system for constructing a foundation for a tower on site from prefabricated structural members comprises a material, the material comprising concrete with several possible implementations, including, pre-cast, cast-in place, reinforced, pre-stressed, pre-tensioned and post-tensioned. To construct the tower foundation, a pit is excavated below the ground surface and the foundation structure is assembled inside the pit from pre-manufactured parts or positioned in the pit pre-assembled.

Figure 2:
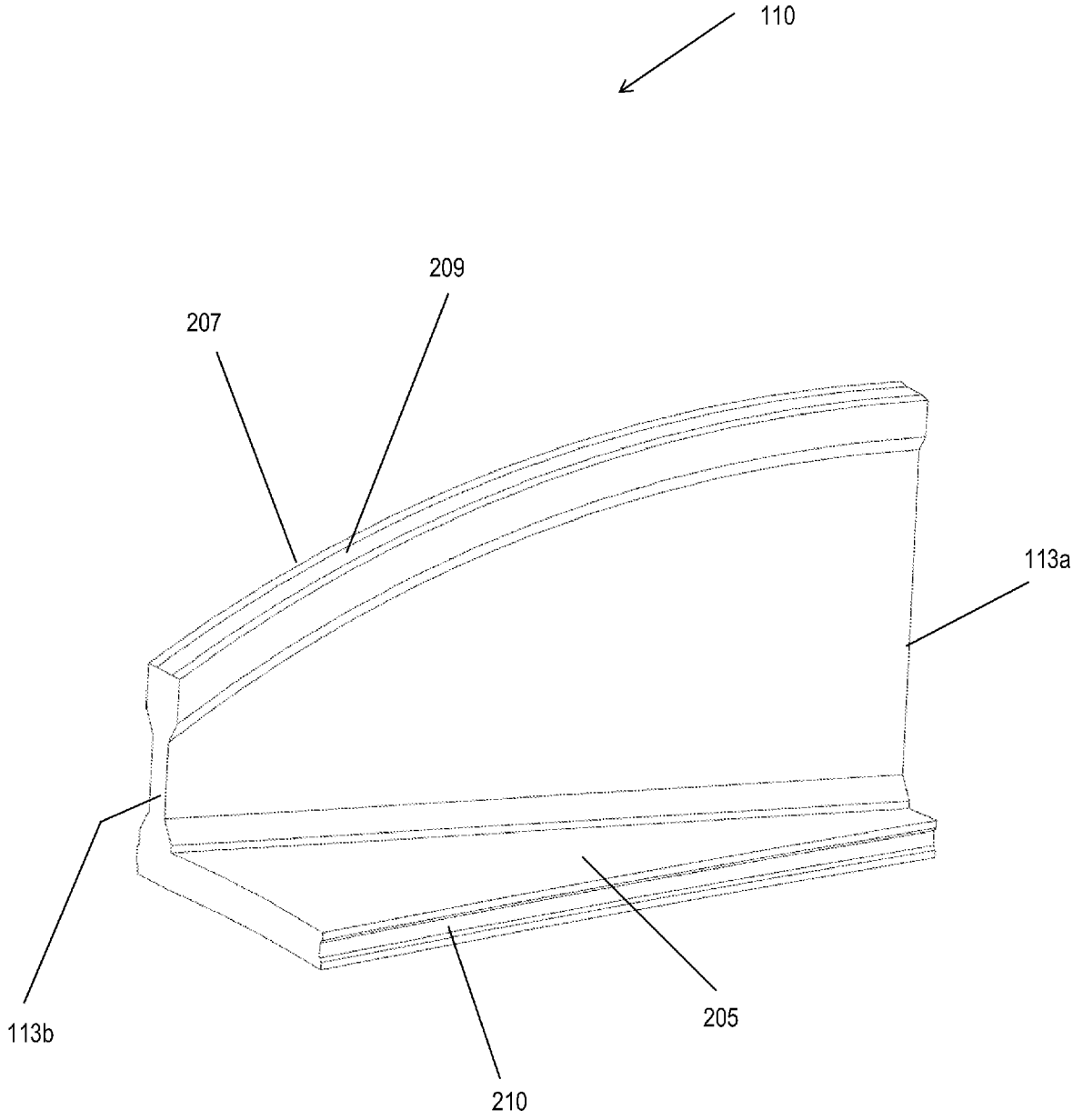
FIG. 2 is a cross sectional view of a structural member according to an embodiment of the invention.

Referring to FIGS. 1 and 2, in appropriate soil conditions, the foundation structure 100 may be buried or placed in an excavated pit and covered with a sufficient volume of fill 125. The fill 125 provides the structural strength to stabilize the foundation structure 100 with a tower (not shown) mounted thereon. The foundation structure 100 includes a plurality of structural members 110. Each structural member 110 comprises material, including concrete with several possible implementations, such as, pre-cast, cast-in place, reinforced, pre-stressed, pre-tensioned and post-tensioned, of sufficient strength and thickness to support at least the weight of the threshold volume of fill 125. Each structural member 110 includes a base member 205. The base member 205 of a first structural member 110 can be coupled with the base member of a second structural member and so on to form an interlocked base 120 for the foundation structure 100. A first end 112*a* of each structural member 110 can be coupled to a central shaft 105. The fill 125 constrains the mass at the base 120 of the foundation structure 100 and keeps it from moving.

The central shaft 105 can be of a large enough diameter to match the tower to be mounted on the foundation structure 100 and long enough to span the entire depth of the foundation structure 100. A fastening member 130 can be located at the top of the central shaft 105 for making the connection between the foundation structure 100 and the base of the tower. Any suitable method or combination of methods for fastening the tower to the foundation may be used, including but not limited to bolts, studs, welds, grouting, and/or threaded receivers. The first end, such as 112*a*, of each structural member 110 can be coupled to the central shaft 105 by bolts, studs, welds, grouting, threaded receivers, and so on. The structural members 110 can transfer compression loads and tension loads from the central shaft 100 to the base 120.

The structural member 110 can comprises a material, including concrete with several possible implementations, including, pre-cast, cast-in place, reinforced, pre-stressed, pre-tensioned and post-tensioned concrete. The first end 112*a* of the structural member 110 can be coupled to the central shaft 105. A second end 112*b* of the structural member 110, opposite the first end 112*a*, can extend outwardly. The structural member 110 can have a substantially arched or a curved top surface 207. At least a portion of the top surface 207 can include a channel 209. At least a portion of the channel 209 can extend substantially along the length of the structural member 110. Fill 125 can be placed in the channel 209.

In some embodiments, the base 120 can be coupled to a reinforcing plate (not shown). The plate can be made of any suitable material, such as, steel or concrete, that can support the weight of a tower. Each structural member 110 can extend radially along the diameter of the plate. As described earlier, these structural members 110 can be made of concrete with several possible implementations, including, pre-cast, cast-in place, reinforced, pre-stressed, pre-tensioned and post-tensioned, steel plates, rods, I-beams, or other suitable material and may be placed in various numbers, groupings, and spacing depending on the required size of the foundation. In some implementations, the central shaft 105 is not directly connected to the plate. In some embodiments, the plate varies in three dimensions (e.g., a basin shape).

Voids 114 can be defined between adjacent structural members. For example, a void 114 is formed between adjacent structural members 110*a* and 110*b*. The voids 114 are configured to receive fill 125.

The material used to make the foundation structure 100 can be determined by the use and conditions surrounding the tower. In some aspects, the components of the foundation structure 100 comprise steel, such as carbon steel or stainless steel. For example, the structural members 110 may comprise steel plates, rods, beams, concrete with several possible implementations, including, pre-cast, cast-in place, reinforced, pre-stressed, pre-tensioned and post-tensioned. Protective coatings may be applied to prevent corrosion. Other materials may be used in conjunction with steel. For example, in a location with large amounts of moisture in the soil a material that would not rust and would be resistant to water damage may be chosen to supplement steel, such as concrete or fiberglass. The material used to construct the foundation structure 100 may be any combination of materials including, but not limited to, a metal, concrete, a composite (e.g., carbon structures), a ceramic, or a plastic. The fill 125 may be any particulate, such as, for example, soil or aggregate that serves as ballast.

The foundation structure 100 can include any number of sensors 140 adapted to detect conditions of and within the foundation. The sensors 140 may be positioned inside the foundation structure 100. For example, one or more sensors 140 may be placed within the foundation structure 100 in order to detect the condition of the fill 125 and/or the material used to construct the foundation structure 100. Further, one or more sensors 142 may be placed on the exterior of the foundation structure 100 in order to detect the condition of the fill/soil 125 surrounding the foundation structure 100 and/or the material used to construct the foundation structure 100. The sensors 140 may be placed in contact with portions of structural members 110 susceptible to high strain. The sensors 140 and 142 may include, but are not limited to, a mechanical strain sensor, a fatigue sensor, a moisture sensor, and a corrosion sensor (e.g., cathodic electrical potential sensors, etc.). The foundation structure 100 may also include a cathodic protection system (not shown) coupled to the foundation structure 100.

Once the foundation structure 100 is positioned (for example, in the excavated pit), a sufficient amount of the fill 125 can be placed over the structural members 110 such that the foundation structure 100 is substantially or completely covered by the fill 125. In one or more embodiments, the voids 114 can be filled with the fill 125. The fill 125 can also be placed within channel 209. In one or more embodiments, the fill 125 can be placed in either the voids 114 or the groove 112*a*. The amount of the fill 125 is sufficient to provide mass and ballast for the foundation structure 100. The fill 125 can have a particular average density such that the weight of the volume of fill 125 is sufficient to counteract expected tension-based lifting forces, such as those resulting from high winds on the tower attached to the foundation structure 100.

These expected tension-based lifting forces are a function of the height of the tower to be mounted and also the aerodynamic characteristics of the tower's particular shape in addition to the size and shape of the planned wind turbine generator and nacelle to be mounted on the tower. Tension force estimates for the tower may be calculated according to height and general design. The weight of the fill 125 required to counteract the tension force estimates may then be calculated. In one example, the weight of the fill 125 is set to equal the weight of the tower.

The fill 125 may be, at least partially, comprised of local materials. The local materials may be from the excavation of the pit into which the foundation structure is placed. The type of fill 125 used will, therefore, depend on the local geology of the construction site. If the site is has a rock substrate, the fill 125 may consist of an aggregate, which may be cleaned and conditioned prior to placement in the foundation. If the site has a predominately soil substrate, the fill 125 consists of local soils Likewise, mixed substrates may produce the fill 125 comprising mixed rock and soil. This mixed substrate may be cleaned and conditioned prior to use. It will be appreciated that the fill 125 may be chosen from a range of possible materials that depends on the type of substrate found at the construction site.

Although existing traditional foundations are typically left in the ground after a site is decommissioned, aspects of the present invention disclosed herein allow easier cleanup and decommissioning of the site because the foundation structure may be removed cost-effectively. In some aspects, the foundation structure may be reused at another site. The ease of removal provided by aspects of the invention enable accurate evaluation of available wind power by providing a cost effective solution to install a full-sized tower and turbine at a site prior to full scale construction and cost-effective removal of the tower and foundation if turbine performance shows the available wind at the site is not suitable for full scale power production.

In another embodiment, the invention comprises a method for constructing a foundation for a tower. The foundation is constructed by excavating a pit of a sufficient size to contain the foundation structure 100. In some embodiments, the depth of the excavated pit is sufficient to contain the foundation structure 100 with a top of the foundation structure 100 located within plus or minus 3 feet of the ground surface. The backfill from the excavation may be reserved. In one embodiment, a foundation structure 100, such as that described above, is assembled inside the excavated pit from a kit including pre-fabricated pieces. In another embodiment, the foundation structure 100, such as the one above, is positioned in the pit at least partially pre-assembled. The partially (or entirely) pre-assembled foundation structure 100 may be fabricated beforehand at a remote location for transport to the construction site, removing fabrication of these elements from the project's critical path. In some implementations (at construction sites with rocky ground or caliche-type soils, for example), the foundation structure 100 is positioned on leveled ground with no excavation performed. Avoiding excavation could reduce costs, particularly in areas where excavation is problematic.

Any suitable method or combination of methods for fastening the components of the foundation may be used, including but not limited to bolts, studs, welding, grouting, and/or threaded receivers. In one embodiment, referring to FIG. 2, the base member 205 of each structural member 110 can include a groove 210 on a first end and a ridge (not shown) on a second end. When the bases of two structural members are brought in contact, the groove in a first structural member can releasably mate with the ridge of the second structural member and so on to form the base 120. In one embodiment, the prefabricated pieces of the foundation structure 100 are fitted together inside the excavated pit or on top of leveled ground at the site and are connected by bolting the pieces together with suitably sized threaded fasteners.

Construction of the foundation is continued by covering the structural members 110 with a volume of fill 125 to provide the mass and ballast to stabilize the foundation and the structure (such as a tower) to be erected upon the foundation. The volume of the fill 125 may be sufficient to counteract expected lifting forces exerted by winds or other forces. The foundation structure 100 may be filled with the backfill reserved from the excavation process.

Constructing the foundation according to aspects of the invention may take as little time as one to two days, in contrast with previous methods of tower construction in which tying rebar for the concrete foundation may take weeks. By minimizing the window for construction, weather delays are reduced. Also, the impact of cold, rain, and heat regarding pouring and curing cement are eliminated. Prefabrication of foundation elements also decreases costs by reducing the size of the required labor force at the site.

Aspects of the present invention include a tower foundation structure kit. The foundation structure kit includes components for constructing the foundation structure discussed herein. Components may be packaged in space-saving or easily handled configurations for storage and shipment. The kit includes the central shaft 105, and a plurality of structural members 110 comprises a material, including concrete with several possible implementations, including, pre-cast, cast-in place, reinforced, pre-stressed, pre-tensioned and post-tensioned.

It should be understood that the inventive concepts disclosed herein are capable of many modifications. It is specifically contemplated that the scope of the present invention includes structural members other than those made with concrete, such as structural members made from reinforced and non-reinforced polymeric materials, composites, laminates, foamed concrete and other structural materials. Thus, the exemplary structural members disclosed hereinafter are not intended to be interpreted as unnecessarily limiting. Other modifications may include types of materials, specific tools and mechanisms used, and so on. To the extent such modifications fall within the scope of the appended claims and their equivalents, they are intended to be covered by this patent. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed.

The invention claimed is:

1. A foundation structure for a tower comprising:

a plurality of structural members, wherein each of the structural members comprises a material, the material comprising concrete, pre-cast concrete, cast-in place concrete, reinforced concrete, pre-stressed concrete, pre-tensioned concrete and post-tensioned concrete, wherein each of the structural members comprises a base member, and wherein the base member of each structural member is coupled to the base member of an adjacent structural member to form a base for the foundation structure; and a central shaft, wherein a first end of each of the structural members is coupled to the central shaft, and wherein the central shaft has a diameter to match a tower to be mounted on the foundation structure, and wherein the foundation structure is placed within a pit, and wherein the foundation structure is covered with a sufficient volume of a particular fill such that a tower coupled to the central shaft is held in position by the fill.

2. The foundation structure according to claim 1, wherein each of the structural members comprises a top surface, and wherein at least a portion of the top surface comprises a channel for receiving the fill.

3. The foundation structure according to claim 2, wherein at least a portion of the channel extends along the length of the structural member.

4. The foundation structure according to claim 1, wherein a void is defined between each adjacent structural member, and wherein the fill is received in the void.

5. The foundation structure according to claim 2, wherein a void is defined between each adjacent structural member, and wherein the fill is received in the void.

6. The foundation structure according to claim 1, wherein the sufficient volume of the fill is at least a threshold volume, the threshold volume comprising a volume of a particular fill of a particular average density such that the weight of the volume of the particular fill is sufficient to counteract expected tension-based lifting forces on the tower.

7. The foundation structure according to claim 1, wherein the base is coupled to plate, wherein the plate comprises a material of sufficient strength and thickness to support at least the weight of the threshold volume of fill.

8. The foundation structure according to claim 1, further comprising a fastening member located at the top of the central shaft, the fastening member connecting the foundation structure to the base of the tower.

9. The foundation structure according to claim 1, wherein the structural members are coupled to the central shaft by at least one of the group consisting of bolts, studs, welds, grouting, and/or threaded receivers.

10. The foundation structure according to claim 7, wherein the plate comprises a steel and/or concrete plate.

11. The foundation structure according to claim 1, wherein the structural members further comprise a plurality of steel and/or concrete plates.

12. The foundation structure according to claim 1, further comprising one or more sensors, wherein the one or more sensors comprises mechanical strain sensors, fatigue sensors, and/or corrosion sensors.

13. A tower foundation comprising:

the foundation structure according to claim 1, positioned inside an excavated pit; and a volume of the fill such that the weight of the volume of the fill is sufficient to counteract an expected tension load transferred to the foundation structure from the tower.

14. The foundation according to claim 13, wherein the depth of the excavated pit is sufficient to contain the foundation structure with a top of the foundation structure located within plus or minus 3 feet of the ground surface.

15. A method of forming a foundation for a tower, comprising:

placing the foundation structure according to claim 1 in an excavated pit, and covering the foundation structure with non-cementitious fill material.

16. The method according to claim 15, wherein the foundation structure is pre-fabricated.

17. The method according to claim 15, further comprising constructing the foundation structure in the excavated pit.

* * * * *